US006332262B1

(12) United States Patent
Sakamoto

(10) Patent No.: US 6,332,262 B1
(45) Date of Patent: Dec. 25, 2001

(54) METHOD OF FABRICATING A LOUDSPEAKER SUSPENSION DEVICE

(75) Inventor: Yoshio Sakamoto, Hachiouji (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 0 days.

(21) Appl. No.: 09/424,149

(22) PCT Filed: Apr. 10, 1998

(86) PCT No.: PCT/JP98/01650

§ 371 Date: Nov. 19, 1999

§ 102(e) Date: Nov. 19, 1999

(87) PCT Pub. No.: WO98/53640

PCT Pub. Date: Nov. 26, 1998

(30) Foreign Application Priority Data

May 22, 1997 (JP) ..... 9-147039

(51) Int. Cl.[7] ..... H04R 31/00
(52) U.S. Cl. ..... 29/594; 29/609.1
(58) Field of Search ..... 29/594, 609.1; 381/423, 429

(56) References Cited

U.S. PATENT DOCUMENTS 4,672,675 6/1987 Powell et al. .

FOREIGN PATENT DOCUMENTS 0 369 434 5/1990 (EP) .
0 479 317 A2 8/1992 (EP) .
0 720 415 A2 7/1996 (EP) .

*Primary Examiner*—Carl E. Hall
(74) *Attorney, Agent, or Firm*—Eric J. Robinson; Nixon Peabody LLP

(57) ABSTRACT

Flat knitted tinsel wires (2*h*) are sewn on a base cloth (B) of a conductive suspension (1) with a sewing thread (3) and the ends (2*ha*, 2*hb*) of the flat knitted tinsel wires extend outward from the conductive suspension (1). In this suspension device, a work load of peeling off the flat knitted tinsel wire ends (2*ha* and 2*hb*) from the base cloth (B) is reduced and associated problems are solved. The flat knitted tinsel wires (2*h*) are sewn on the base cloth (B), with the flat knitted tinsel wire ends (2*ha*, 2*hb*) being positioned at base close holes (B1), and thermally pressed and trimmed together with the base cloth (B).

12 Claims, 16 Drawing Sheets

METHOD OF FABRICATING A LOUDSPEAKER SUSPENSION DEVICE

BACKGROUND OF THE INVENTION

1. Field of the Invention

The present invention relates to a loudspeaker suspension device and a fabricating method thereof, and more particularly to a loudspeaker suspension device and a fabricating method thereof, capable of providing an improved connection state of signal input ends of voice coil connection conductors.

2. Related Background Art

In order to reduce the number of wiring steps of a loudspeaker, various types of dampers with conductors 2 (hereinafter called "conductive damper ID) have been proposed heretofore, in which the conductors 2 are provided along corrugations 11*c* of a suspension 1 generally called spiders or dampers. However, these conductive dampers 1D are not satisfactory in terms of practical use. As described in EP 0 369 434 A2 and EP 0 479 317 A2, the inventors have proposed practically usable conductive dampers (hereinafter called "sewn conductive dampers 1D*s*) which are already under mass production. This sewn conductive damper uses as the conductors 2 conductive wires (hereinafter called "flat knitted tinsel wires 2*h*) made of a desired number of flat knitted conductive wires each formed by winding a copper foil around fibers. This flat knitted tinsel wire is sewn on a base cloth B made of woven cloth and constituting a suspension 1. The base cloth B with the sewn flat knitted tinsel wires is thermally molded to attache the conductors 2 along corrugations 11*c*. An edge (hereinafter called a "conductive edge 1E") utilizing the technology proposed by the inventors has also been proposed.

A loudspeaker suspension 1 such as a sewn conductive damper 1D*s* and a conductive edge 1E, having conductor 2 along corrugations 11*c* or roll 11*r* of the suspension 1, is called a "conductive suspension 1".

The structure of the conductive suspension 1 having the conductors 2 mounted along the corrugations 11*c* or roll 11*r* of a conventional general loudspeaker suspension will be described by taking as an example the conductive damper 1D and the conductive edge 1E. In manufacturing the conductive damper 1D, for example, in manufacturing the sewn conductive damper 1D*s* proposed by the present inventors, phenol resin raw liquid generally sold in markets is diluted with methanol to obtain phenol resin solution having a desired specific gravity. Woven cloth made of cotton or chemical fibers is dipped in this solution to impregnate or coat it with the phenol resin. After the methanol solvent is evaporated to remove resin tucking, the woven cloth is cut to have a predetermined width. In this manner, the base cloth B used for damper molding is prepared.

Two flat knitted tinsel wires 2*h* as the conductors 2 are sewn to the base cloth B with sewing threads 3 called cornex, in parallel along the center line and at a predetermined space relative to the center line, as shown in FIG. 8. After the flat knitted tinsel wires 2*h* are sewn, the base cloth B is thermally pressed, similar to general dampers, to integrally mold the corrugations 11*c* concentrically to the center line of the base cloth B, as shown in FIG. 9. Thereafter, unnecessary portions indicated by broken lines in FIG. 10 are trimmed through punching press. In this manner the sewn conductive damper 1D with the flat knitted tinsel wires 2*h* being mounted along the corrugations 11*c* can be obtained as shown in FIGS. 11A and 11B.

The manufacture of the conductive edge 1E, for example, the sewn conductive edge 1E*s* (refer to FIG. 3 of an embodiment of the invention) the present inventors have proposed in practical use, is basically the same as the manufacture of the sewn conductive damper 1D*s*. Specifically, a predetermined woven cloth is impregnated with phenol resin or the like having a predetermined concentration and coated with a predetermined damping material such as synthetic rubber to prepare the edge material. This edge material is cut to have a predetermined width to prepare the base cloth B to be used for edge molding. Two flat knitted tinsel wires 2*h* similar to the above-described wires 2*h* as the conductors 2 are sewn to the base cloth B with sewing threads 3 called cornex, in parallel along the center line and at a predetermined space relative to the center line.

After the flat knitted tinsel wires 2*h* are sewn, the base cloth B is thermally pressed, similar to general edge molding, to integrally mold the roll 11*r* relative to the center line of the base cloth B. Thereafter, unnecessary portions are trimmed. Generally, if the unnecessary portions are cut through punching press, the sewn conductive edge 1E*s* with the flat knitted tinsel wires 2*h* being mounted along the roll 11*r* can be obtained.

The structure of the conductive suspension 1 of a conventional loudspeaker is fabricated in the above method. It is therefore obvious that the conductor 2 made of the flat knitted tinsel wire 2*h* is disposed on the front surface of the suspension base cloth B made of a woven cloth impregnated or coated with resin. Therefore, exposed is only one side of the conductor 2, i.e., the flat knitted tinsel wire 2*h*, and the other side is hidden in contact with the suspension base cloth B.

Next, a means for electrically interconnecting the conductor 2 and an input terminal lug 4 will be described by taking as an example the sewn conductive damper 1D*s*. As shown in FIGS. 11A and 11B, tongue-shaped projections (hereinafter called tongue portions 13*a* and 13*b*) are provided extending outward from an adhesion portion 12 at the circumferential area of the sewn conductive damper where the conductors 2 or sewn flat knitted tinsel wires 2*h* reach. The ends 2*ha* and 2*hb* of the flat knitted tinsel wires 2*h* extend on the tongue portions 13*a* and 13*b*.

In order to perform electrical connection under the conditions that the sewn conductive damper 1D*s* is mounted on a speaker frame F, as shown in FIG. 12, the tongue portions 13*a* and 13*b* are disposed on input terminals mounted on the speaker frame F. The surfaces of the ends 2*ha* and 2*hb* of the flat knitted tinsel wires 2*h* at the tongue portions 13*a* and 13*b* are made in contact with, or pressed against, partial areas of terminal lugs 4*a* and 4*b*, and the contact areas or pressed areas of the lugs 4*a* and 4*b* are soldered. Therefore, partial areas of the terminal lugs 4*a* and 4*b* are made always in contact with the front surfaces of the conductors 2 (flat knitted tinsel wire ends 2*ha* and 2*hb*).

Another approach is to separate the ends of conductors 2 or flat knitted tinsel wire ends of the sewn conductive damper 1D*s* from the damper base cloth B to expose both the front and back surfaces of the flat knitted tinsel wire ends 2*ha* and 2*hb* and jump the ends 2*ha* and 2*hb* directly to the input terminal lugs 4. This connection structure of the sewn conductive damper 1D*s* has been proposed by the present inventors, as described in Japanese Patent Laid-Open Gazette No. HEI 2-134100 and Utility Model Laid-Open Gazette No. HEI 2-13398.

In this electrical connection process, as shown in FIGS. 13A and 13B, the tongue portions 13*a* and 13*b* at the damper circumferential area are required to be separated from the flat knitted tinsel wire ends 2*ha* and 2*hb* on the tongue portions 13*a* and 13*b*, by loosening the sewing thread 3 in the range from the outermost ends of the tongue portions 13*a* and 13*b* to the outermost circumference of the adhesive area 12. It is also necessary to peel off the flat knitted tinsel wire ends 2*ha* and 2*hb* from the tongue portions 13*a* and 13*b* to cut the loosened threads 3. Thereafter, both the front and back surfaces of the flat knitted tinsel wire ends 2*ha* and 2*hb* are exposed to separate them from the damper base cloth B (tongue portions 13*a* and 13*b*). This process, however, has the problems of (1) high cost and (2) unstable product quality.

The reason of the high cost (1) is as follows. The process of loosening the sewing threads 3 is very complicated and the number of works increases, resulting in the high cost. The unstable product quality (2) results from a variation in the works of loosening the sewing threads 3. If the thread 3 is loosened too much, it is loosened even near to the ends of the corrugations 11*c*, and the unfastened portion is formed at the outermost circumference of the corrugations 11*c*.

In operation of the sewn conductive damper 1D*s* having the unfastened portion near at the corrugations 11*c*, since the corrugations 11*s* are movable, they vibrate and the flat knitted tinsel wires 2*h* near at the corrugations contact with the damper base cloth B to generate abnormal sounds called vibratory sounds. If such a state continues for a long time, the copper foils constituting the flat knitted tinsel wires 2*h* at the unfastened portion are cut, resulting in a fatal defect of no sound from the loudspeaker.

Even if the portion where the sewing thread 3 is loosened does not reach the outermost circumference of the corrugations 11*c*, the end of the sewing thread 3 may be loosened by vibrations or impacts during the transportation of the damper, and this loosened portion may often reach the outermost circumference of the corrugations 11*c*. From the reasons described above, an approach to separating the conductors 2 (flat knitted tinsel wires 2*h*) of the sewn conductive damper 1D*s* from the damper base cloth B (tongue portions 13*a* and 13*b*) is not still realized to date.

There are some advantageous cases, however, if the conductors 2 are separated from the damper base cloth B, i.e., if both the front and back sides of the ends 2*ha* and 2*hb* of the flat knitted tinsel wires 2*h* are exposed not to intentionally mount the conductors 2 on the woven cloth (at the tongue portions 13*a* and 13*b* or the like) of the base cloth B of the sewn conductive damper 1D*s*. For example, such a case occurs if the conductive damper 1D is used with a terminal ring L or the like provided with wiring patterns the present inventors have proposed.

Specifically, in the case of the sewn conductive damper 1D*a* (FIG. 12) with the conductors reaching the tongue portions 13*a* and 13*b*, the woven cloth (at the tongue portions 13*a* and 13*b* or the like) of the suspension base cloth B is interposed at a contact surface between the ends 2*ha* and 2*hb* of the flat knitted tinsel wires 2*h* and the wiring conductive patterns (FIG. 14). Therefore, electrical connection by soldering is almost impossible. In order to allow soldering, the present inventors have proposed specific conductive dampers 1D which we call a woven conductive damper 1D*i*.

More in detail, a terminal ring L formed through punching press of a printed circuit board or the like made of a resin board attached with copper foils or the like, is integrally formed with three projections L1, L2 and L3 separated by 90° about the ring center, as shown in FIG. 14. The projection L1 is formed at the position where terminals are mounted, and the other two projections L2 and L3 are formed at the positions separated by 180° about the ring center. A wiring pattern P is also formed on the side where the conductive damper 1D is mounted. Square holes L11 for mounting terminal lugs 4 are formed as shown in FIG. 14 in the tongue-shaped projection L1 on which the input terminals are connected. Caulking portions 41 of the terminal lugs 4 are inserted into the holes L11 and caulked to press a partial area of each terminal lug 4 against the surface of the wiring pattern P to thus complete the ring L with the terminal lugs 4.

In manufacturing the damper, fibers constituting the base cloth B is impregnated with phenol resin having a predetermined concentration and diluted with methanol, and the solvent is evaporated to remove resin tucking. Fibers impregnated with the resin are used as warps and fibers not impregnated with the resin are used as yarns, and one flat knitted tinsel wire 2*h* is woven on the side of yarns. The base woven cloth B with the flat knitted tinsel wire 2*h* disposed on the center line of the damper corrugations 11*c* is thermally molded to obtain the woven conductive damper 1D*i*.

Since a damper inner diameter portion 13 (FIG. 11) is cut by a trimming process, the flat knitted tinsel wire 2*h* disposed on the damper center line is cut so that two flat knitted tinsel wires 2*h* are disposed along the damper center line. At the trimming process, two tongue portions 13*a* and 13*b* are formed outside of the adhesion portion 12 at the damper circumferential area, as shown in FIG. 14, so that the flat knitted tinsel wire ends 2*ha* and 2*hb* reach the tongue portions 13*a* and 13*b*. Since the woven conductive damper 1D*i* has the structure that the flat knitted tinsel wire 2*h* is woven in the woven cloth, the copper foils of the flat knitted tinsel wire 2*h* as the conductor 2 are exposed between fibers constituting the woven cloth (between weaving spaces).

As shown in FIG. 14, a predetermined amount of rubber-containing adhesion h is coated on the inner peripheral area of the terminal ring L, and the terminal ring L is dried for a predetermined time to evaporate the solvent of the adhesive h. Cream solder sc (FIG. 15) is coated on a predetermined area of the pattern P on the projections L2 and L3, i.e., on the area where the ends of the flat knitted tinsel wires 2*h* of the woven conductive wire 1D*i* reach. The damper adhesion portion 12 and the outer circumferential portion of the ring L with the terminals are aligned in position, and the damper tongue portions 13*a* and 13*b* and the ring projections L2 and L3 are aligned in position. Therefore, the adhesive portion 12 of the woven conductive damper 1D*i* and the area with the adhesive h are made in contact with each other, and the cream solder sc and the exposed areas of the back surface of the flat knitted tinsel wires reaching the projections of the woven conductive damper 1D*i* are made in contact with each other.

In this state, thermal press is applied for several seconds at about 250° C. down to the adhesion portion 12 and tongue portions 13*a* and 13*b* of the damper 1D*i* to thermally reactivate the adhesive h. While the adhesion portion 12 of the woven conductive damper 1D*i* is attached to the terminal ring L and the cream solder sc is melted, the exposed areas of the back surfaces of the flat knitted tinsel wire ends 2*ha* and 2*hb* reaching the tongue portions 13*a* and 13*b* of the woven conductive damper 1D*i* are soldered to the wiring patterns P of the ring L. In this manner, the woven conductive damper 1D*i* with the ring L and the terminal lugs 4 can be formed (refer to FIG. 15).

During the thermal press, phenol resin or the like will not be attached to the flat knitted tinsel wires 2*h* as the conductors 2 of the woven conductive damper 1D*i*. Furthermore, the copper foils constituting the flat knitted tinsel wires 2*h* are exposed between weaving spaces of the base woven cloth B and the exposed areas are made in contact with the wiring conductive patterns P of the ring L. Therefore, it is easy to solder. However, a general sewn conductive damper 1D*s* with the tongue portions 13*a* and 13*b* reaching the conductors 2 (flat knitted tinsel wire ends 2*ha* and 2*hb*) is difficult to use with such a structure described above. The types of conductive dampers ID are therefore limited and the use range of the ring L with the wiring conductive patterns P is narrowed.

In order to solve this problem, it is necessary that copper foils of the conductors 2 or flat knitted tinsel wire ends 2*ha* and 2*hb* are intentionally disposed to be separated from the base woven cloth B of the sewn conductive damper 1D*a*. In order to separate the flat knitted tinsel wire ends 2*ha* and 2*hb* reaching the tongue portions 13*a* and 13*b*, as described previously, the sewing threads 3 were loosened to peel off the flat knitted tinsel wires 2*h* from the tongue portions 13*a* and 13*b*, and the tongue portions 13*a* and 13*b* and the loosened threads 3 were cut. However, although the problem (1) of the increased works may be absorbed in the total number of manufacture processes of a loudspeaker, the problem (2) causing a fatal defect could not be solved.

Specifically, the ends of the sewing thread of the sewn conductive damper 1D*s* reaching the outer circumference of the adhesion portion 12 or the outermost end of the tongue portion are subjected to the thermal molding, under the conditions that the ends are in tight contact with the flat knitted tinsel wires 2*h* and damper base cloth B. Therefore, the ends are maintained in tight contact even after the molding. Furthermore, the sewing threads 3 on the base cloth B are in a semi-adhered state caused by phenol impregnated to the woven cloth. Therefore, the sewing threads 3 reaching the outermost area will not loosened unless a particular force is applied thereto.

However, if the tightly molded sewing threads 3 are once forcibly loosened, the tightly molded state or semi-adhered state of the sewing threads 3 is broken and the ends of the sewing threads 3 are loosened. In such a case, it has been found that if the separated or unfastened portion of the flat knitted tinsel wires 2*h* reaches near the middle portion of the adhesion portion 12 and if the sewing thread 3 was cut at the outer circumferential area of the adhesion portion 12, because of a variation in the loosening degree of the sewing threads 3, then many of the sewing threads 3 are loosened near to the outermost corrugation 11*c* by a very small external force, particularly by a very small external force applied to the flat knitted tinsel wire ends 2*ha* and 2*hb* during product transportation.

An example of an advantageous case will be described with reference to FIG. 16, the advantageous case being realized if the exposed areas of the conductors 2 or flat knitted tinsel wire ends 2*ha* and 2*hb* or the like of the conductive edge 1E are not mounted on the woven cloth B of the edge. For example, such a case occurs when the flat knitted tinsel wire ends 2*ha* and 2*hb* are required to be disposed on the back side of the edge 1E. In such a case, in order to electrically interconnect the flat knitted tinsel wire ends 2*ha* and 2*hb* to the input terminal lugs 4, the tongue portions 13*a* and 13*b* are provided as in conventional manner to dispose the flat knitted tinsel wire ends 2*ha* and 2*hb* on the input terminal lugs 4 for making them in contact with each other. In this state, however, as shown in FIG. 16, the edge base cloth B covers the whole surface of the terminal lugs 4 and the whole surface of the contact area between the flat knitted tinsel wire ends 2*ha* and 2*hb* and the terminal lugs 4.

Therefore, although it is easy to make the flat knitted tinsel wire ends 2*ha* and 2*hb* in contact with the terminal lugs 4, it is very difficult to maintain a state that the flat knitted tinsel wire ends 2*ha* and 2*hb* are pressed and fixed to the terminal lugs 4. Moreover, since the edge base cloth B having good electrical insulation covers the flat knitted tinsel wire ends 2*ha* and 2*hb* as shown in FIG. 16, it is difficult to achieve reliable soldering with the solder s and a soldering work itself is very difficult.

As a countermeasure for this, the flat knitted tinsel wire ends 2*ha* and 2*hb* reaching the tongue portions 13*a* and 13*b* made of the edge base cloth B may be separated to loosen the sewing threads 3 and peel off the flat knitted tinsel wire ends 2*ha* and 2*hb* from the tongue portions 13*a* and 13*b* to thereby cut the tongue portions 13*a* and 13*b* and not to interpose the base cloth B. Even in this state, similar to the above-described case, the sewing threads 3 are loosened to the roll portion 11*r* and the unfastened portion is formed to the roll portion 11*r*.

There is also another electrical connection approach. Specifically, the tongue portions 13*a* and 13*b* are provided at the areas where the flat knitted tinsel wire ends 2*ha* and 2*hb* outside of the adhesion portion 12 of the edge 1E reach, and the tongue portions 13*a* and 13*b* are bent to the front side whereas the back surface side of the flat knitted tinsel wire ends 2*ha* and 2*hb* reaching the tongue portions 13*a* and 13*b* is turned to the front side to expose it at the front side of the edge base cloth B, as shown in FIGS. 16A and 16B, to thereby press the exposed area against partial areas of the terminal lugs. This approach obviously requires an additional process of bending the tongue portions 13*a* and 13*b*, and the terminal lugs 4 are required to have a specific shape as shown.

SUMMARY OF THE INVENTION

It is an object of the present invention to solve the above conventional problems and provide a loudspeaker suspension device and its fabricating method capable of manufacturing the loudspeaker suspension device with low cost.

A loudspeaker suspension device applied with the fabricating method of this invention has a suspension and voice coil connection conductors mounted on a surface of the suspension. The fabricating method of this invention comprising the steps of: (a) mounting the voice coil connection conductors along a surface of a planar base member, the base member including cut portions at positions corresponding to signal input ends of the voice coil connection conductors; (b) pressure molding the base member and the voice coil connection conductors into predetermined shapes; and (c) trimming the base member and the voice coil connection conductors so as to leave the signal input ends of the voice coil connection conductors as projection portions from the base member.

After the trimming, the signal input ends of the voice coil connection conductors are present as the projection portions outside of the suspension. It is therefore unnecessary to peel off the signal input terminals from the suspension, and it is possible to prevent a loosened state of the voice coil connection conductors and to stop peeling the voice coil connection conductors from the suspension.

According to the fabricating method for a loudspeaker suspension device of this invention, the cut portions are holes formed in the suspension, and a sewing thread for mounting the voice coil connection conductors on the base member is fastened to the voice coil connection conductors including a portion of the voice coil connection conductors corresponding to the holes.

If the signal input ends of the voice coil connection conductors sewn on the base member with the sewing thread is to be peeled off from the base member, it is necessary to pull out the sewing threads from the base member, which may result in a loosened state of the voice coil connection conductors and the voice coil connection conductors peeled off from the suspension. However, in this invention, the unnecessary sewing threads and base member are trimmed and it is not necessary to pull out the sewing threads from the voice coil connection conductors. Therefore, the above problems can be solved.

According to the fabricating method for a loudspeaker suspension device of this invention, the pressure molding is thermal press, and the signal input ends of the voice coil connection conductors are coated with cream solder and thereafter thermally pressed together with the base member.

The cream solder is melted during the thermal press and attached to the signal input ends. Therefore, a loosened state of the signal input ends can be effectively prevented when the voice coil connection conductors are trimmed.

A loudspeaker suspension device of this invention comprises: (a) a suspension made of a planar base member having cut portions at predetermined positions, the planar base member being pressure molded and trimmed with trimming lines passing the cut portions; and (b) voice coil connection conductors mounted on the suspension with signal input ends of the voice coil connection conductors being positioned at the cut portions, the voice coil connection conductors and the suspension being pressure molded and trimmed along the trimming lines.

The signal input ends of the voice coil connection conductors are positioned at the cut portions of the base member and trimmed together with the base member along the trimming lines. It is therefore unnecessary to peel off the signal input terminals from the suspension, and it is possible to prevent a loosened state of the voice coil connection conductors and to stop peeling the voice coil connection conductors from the suspension.

According to the loudspeaker suspension device of this invention, the suspension includes inner adhesion portions, a roll portion and an outer adhesion portion in the order from the inside to the outside, and the voice coil connection conductors traverse at end portions thereof the roll portion and extend at an intermediate portion thereof the inner adhesion portions.

Such a loudspeaker suspension device is used, for example, with an elongated thin loudspeaker.

According to the loudspeaker suspension device of this invention, the cut portions are holes formed in said suspension, and a sewing thread for mounting said voice coil connection conductors on the base member is fastened to the voice coil connection conductors including a portion of the voice coil connection conductors corresponding to the holes.

Although the voice coil connection conductors are sewn on the base member with the sewing threads, the unnecessary signal input ends and the base member are trimmed. Accordingly, it is unnecessary to peel off parts of the voice coil connection conductors from the base member, so that a work to pull the sewing threads from the base member can be dispensed with.

DETAILED DESCRIPTION OF THE PREFERRED EMBODIMENT

Figure 1:
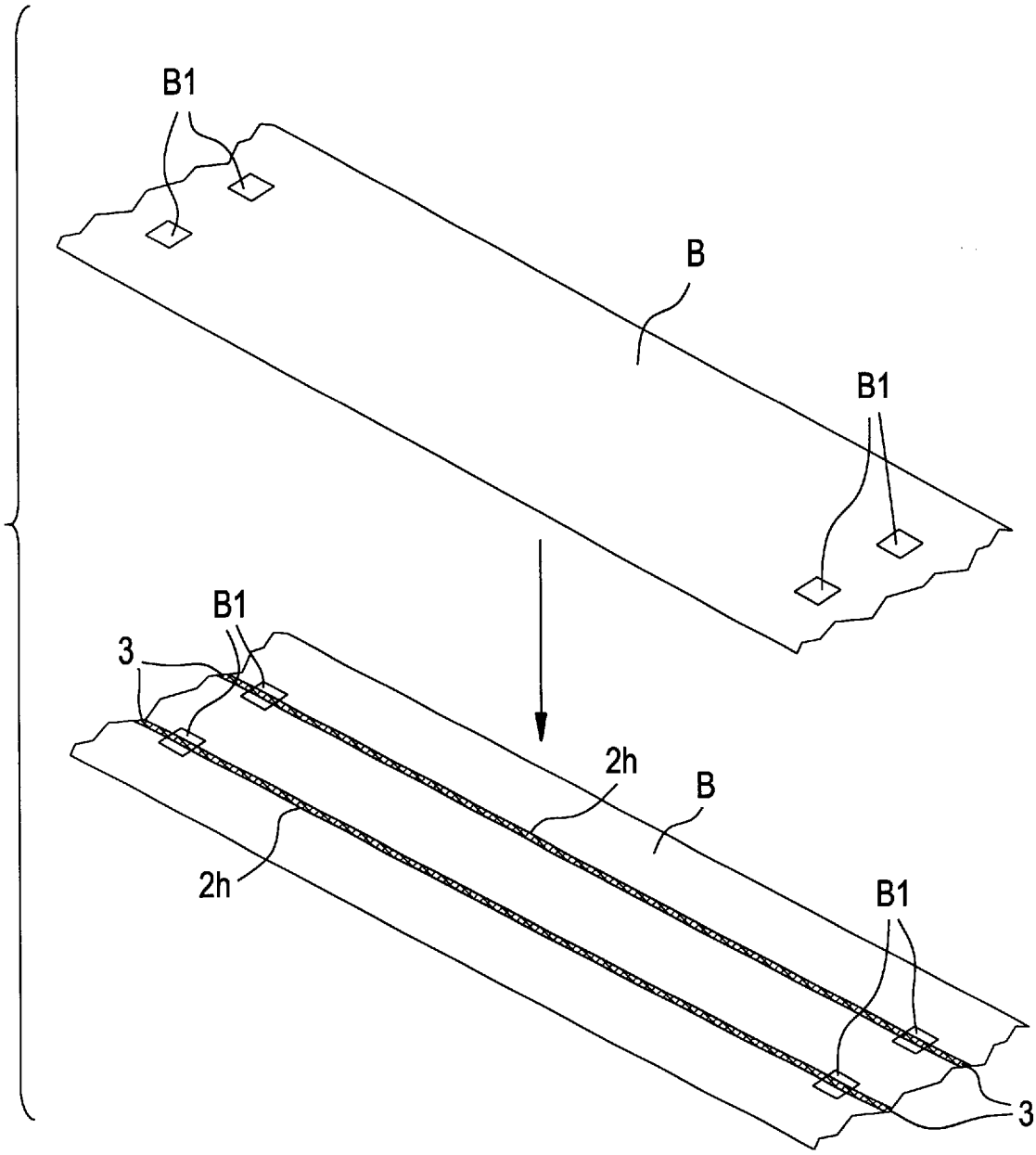
FIG. 1 is perspective views of a base cloth of a sewn conductive edge formed with holes and sewn with flat knitted tinsel wires with sewing threads, according to the invention.

An embodiment of the invention will be described with reference to FIGS. 1 to 7. Like constituent elements to those conventional elements shown in FIG. 8 to FIG. 16B are represented by using identical reference numerals. Although the embodiment will be described by taking a sewn conductive edge 1E*s*, a sewn conductive damper may also be formed in a similar manner. The diaphragm of the sewn conductive edge 1E*s* is an elongated type having a height/width ratio of about 6:1, and is used for a multi-point drive type loudspeaker in which the diaphragm is driven by three voice coils and three repulsion magnetic circuits. In this embodiment, the design conditions are that an edge roll 11*r* is an up-roll and that edge adhesion portions 14 used for adhering the diaphragm df and the voice coil wiring portions are not visible from the front side of the loudspeaker. In order to satisfy these design conditions, input conductors 2 are disposed on the back side of the edge roll 11*r*.

Edge woven cloth widely used conventionally was used for a base cloth B of the edge. As warps and yarns, a thread made of a single twisted fiber of #30 was used. Threads were woven at a density of 60 threads/inch for both the warps and yarns to obtain a cotton cloth having a weight of 100 g to 110 g/m$^2$. This cotton cloth was impregnated with resin solution having a phenol concentration of 24%, and coated with solution mixed with synthetic rubber such as NBR and SBR. This rubber coated cotton cloth was dried with heated air and thereafter cut with a slitter to have a width of about 80 mm. In this manner, a rubber coated edge base cloth B with a roll 11*r* was formed which are presently used widely in this technical field.

Square holes B1 (7 mm×5 mm) such as shown in FIG. 1 were formed in the base cloth B at predetermined positions with a predetermined space therebetween. A desired number of conductive wires generally called tinsel wires made of fibers around which copper foils are wound, were woven flat to form a flat knitted tinsel wire 2*h*. The flat knitted tinsel wires 2*h* as conductors 2 were sewn on the base cloth B with threads 3 called cornex #40, in parallel and separately from the center line of the woven cloth B by 13 mm (a pitch of about 26 mm).

The flat knitted tinsel wire 2*h* was formed in the following manner. A tin-copper alloy wire having a bus bar diameter of 0.1 mm was worked to a foil having a width of 0.32 mm and a thickness of 0.027 mm, and the foil was wound in a single layer at 22+/−2 turns/cm around a paraaramid fiber of 200 denier to form a tinsel wire. A bundle of seven tinsel wires was knitted flat at a knitting pitch of 27.45+/−0.82 mm/turn to form a flat knitted tinsel wire.

Figure 2:
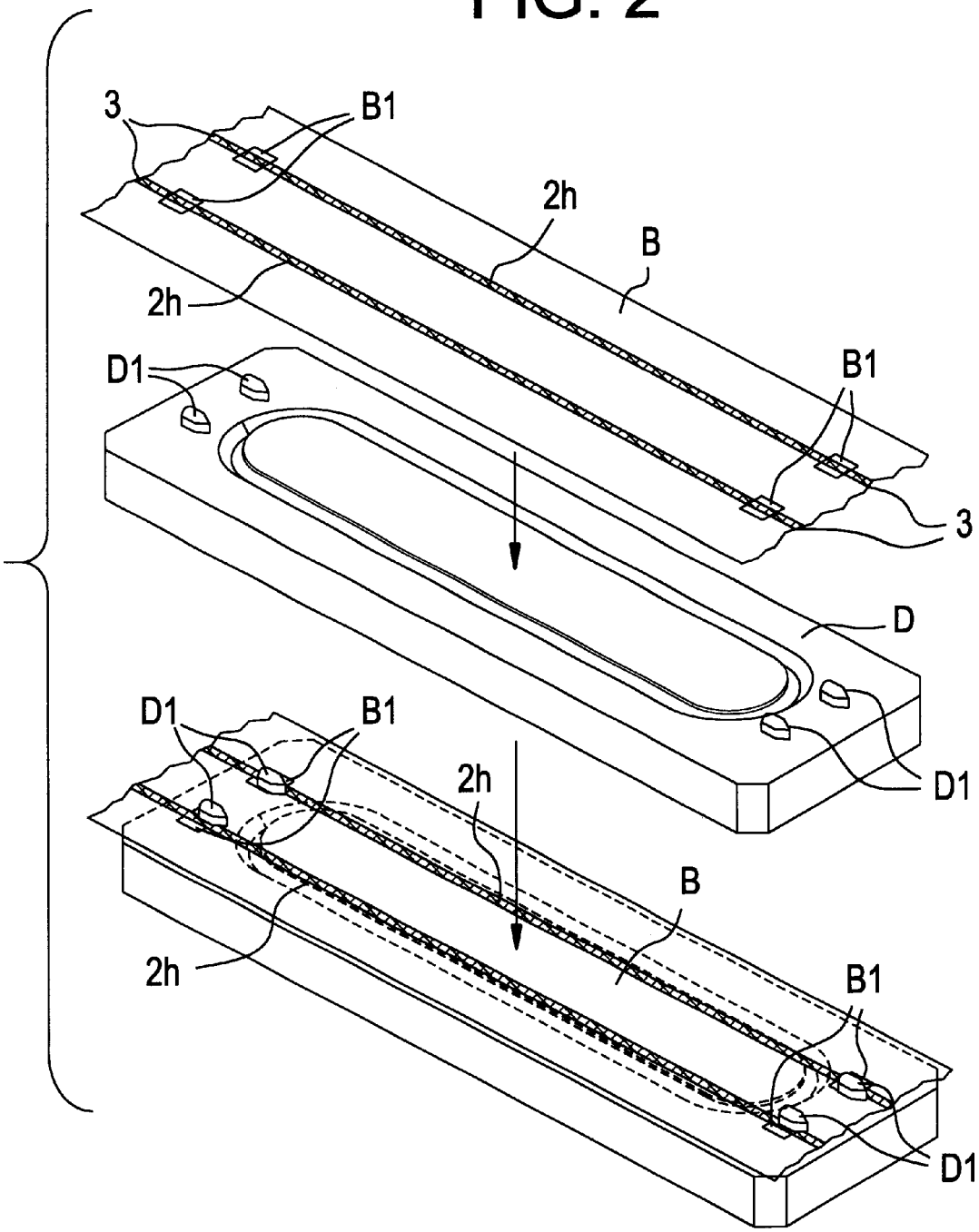
FIG. 2 is perspective views showing the base cloth of a conductive edge placed on a lower mold, according to the invention.

As the flat knitted tinsel wires 2*h* are sewn in the above manner, parts of the flat knitted tinsel wires 2*h* traverse the square holes B1 formed in the base cloth B as shown in FIG. 1, partitioning each square hole B1 into two equal sections. The base cloth B is then placed on a lower mold D for thermal molding, as shown in FIG. 2. Since guide pins D1 are mounted on this mold D at positions corresponding to the partitioned square holes B1, the base cloth B is placed in such a manner that the guide pins D1 are inserted into respective sections of the square holes B1 partitioned by the flat knitted tinsel wires 2*h*.

Figure 3:
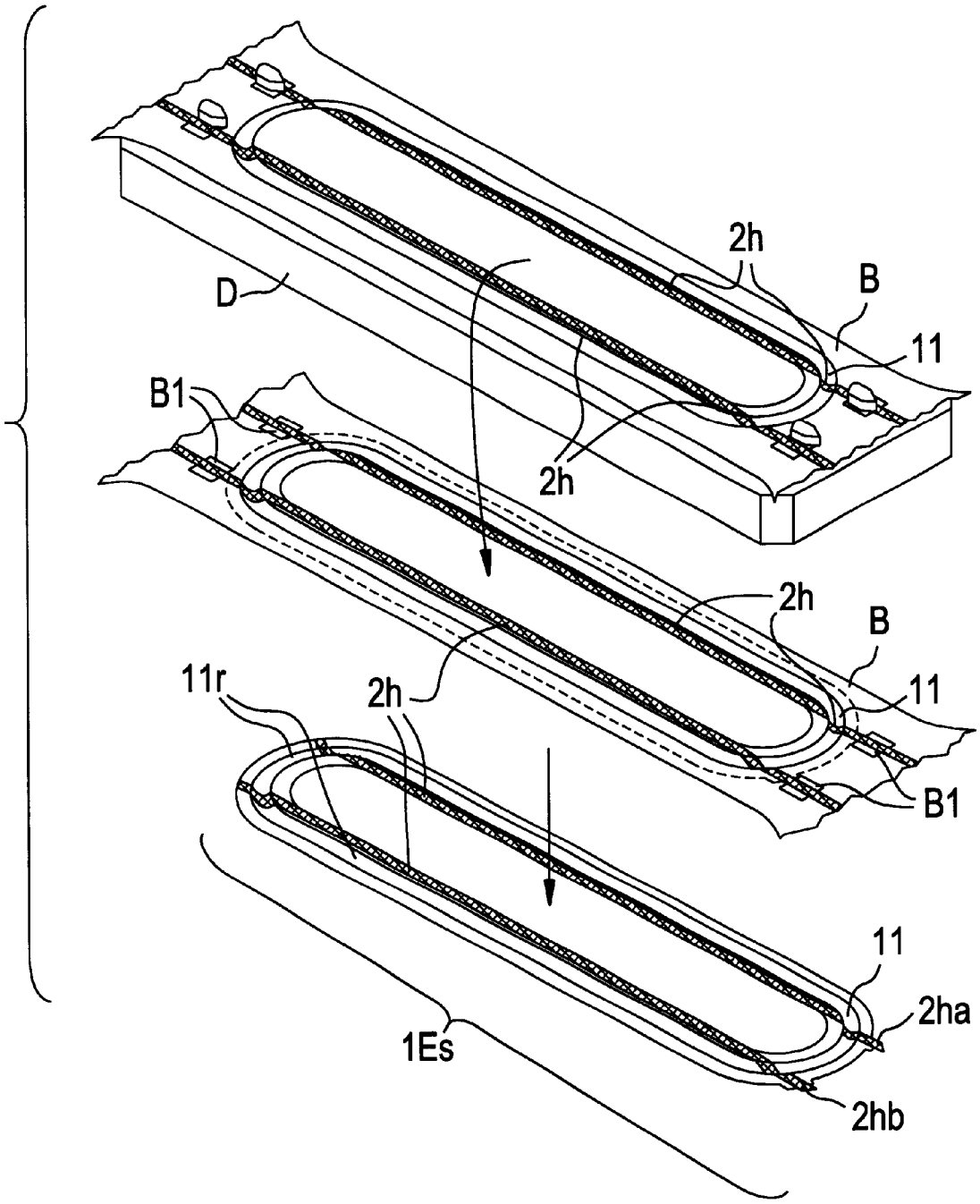
FIG. 3 is perspective views showing the sewn conductive edge molded and thereafter trimmed, according to the present invention.

The temperature of the mold is set to about 200° C. An upper mold is lowered to thermally press the base cloth B at a pressure of about 600 Kg (at an axial output) for about 5 seconds to cure the phenol resin or the like impregnated in the base cloth B and form a roll 11*r* having a predetermined shape at a predetermined area of the base cloth B, as shown in FIG. 3. The molded base cloth B removed from the molds has the flat knitted tinsel wires 2*h* shaped in conformity with the topology of the roll 11*r*.

This edge base cloth B with the molded roll 11*r* and the two flat knitted tinsel wires 2*h* aligned in position is then subjected to a trimming process to cut unnecessary inner and outer portions indicated by broken lines in FIG. 3 and complete a sewn conductive edge 1E*s*. In this embodiment, a trimming mold was prepared and the molded base cloth B with the flat knitted tinsel wires 2*h* was placed on the trimming mold to punch out the unnecessary portions and obtain a desired sewn conductive edge 1E*s* such as shown in FIGS. 3 and 4.

Figure 4:
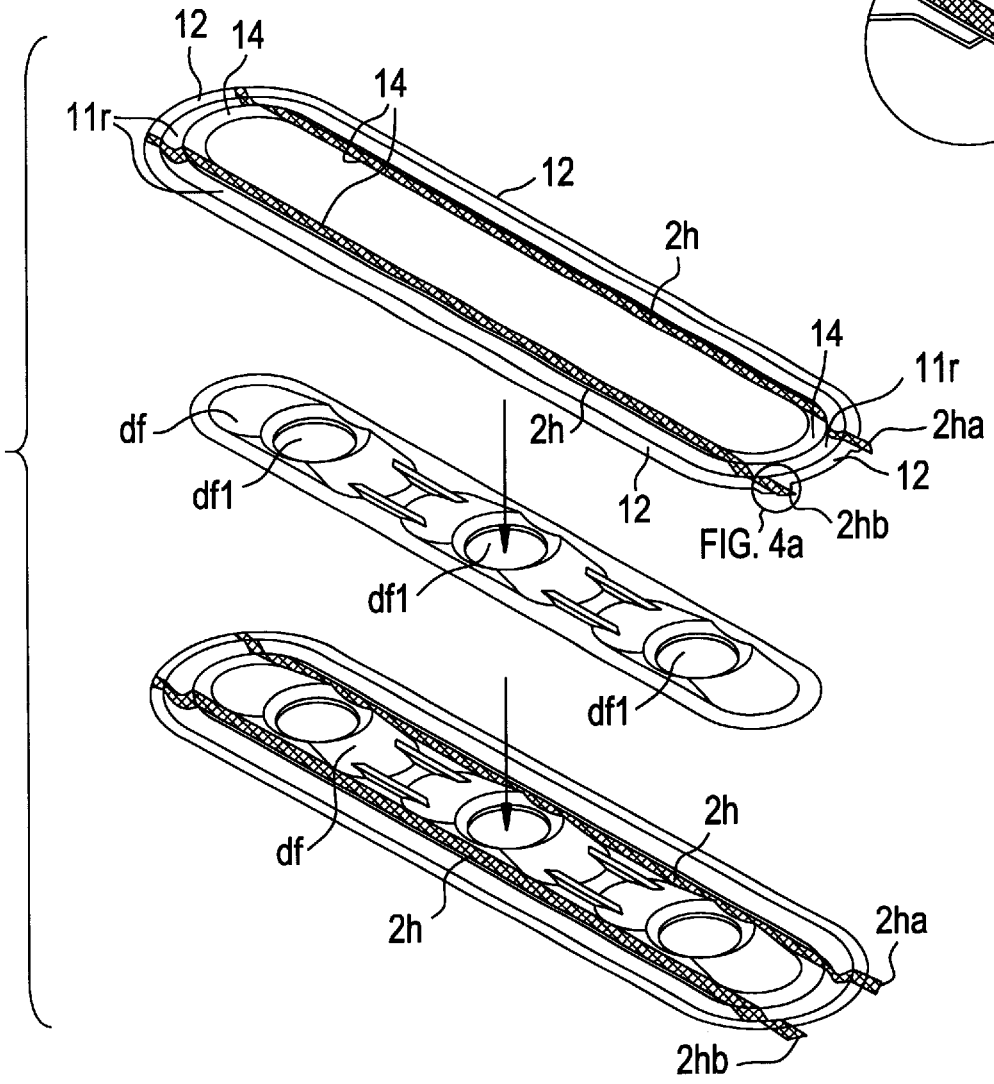
FIG. 4 is a perspective view showing the back side of the sewn conductive edge mounted with a diaphragm and a partially enlarged perspective view showing the back side of the flat knitted tinsel wire ends, according to the present invention.
Figure 4A:
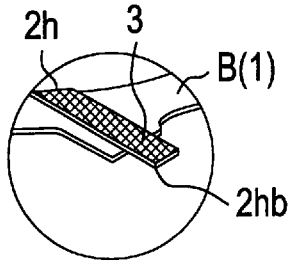

As shown in FIGS. 3 and 4, the end portions of the flat knitted tinsel wires 2*h* placed over the square holes are cut by the trimming process to have a predetermined size as shown in FIGS. 3 and 4. Each of these end portions constitutes a tongue portion outside of the edge adhesion portion 12 without the base cloth B. Namely, this tongue portion exposes both the front and back surfaces of the flat knitted tinsel wires 2*h* outside of the adhesion portion 12. In addition, as shown in a partially enlarged view of FIG. 4, the sewing threads 3 extend to the ends (extended portions) 2*ha* and 2*hb* of the flat knitted tinsel wires 2*h*.

Since the sewing threads 3 extending to the ends (extended portions) 2*ha* and 2*hb* of the flat knitted tinsel wires 2*h* were subjected to the thermal press molding, they were molded along the surface of the flat knitted tinsel wires 2*h* in a fitted manner. Therefore, the sewing threads 3 are in tight contact with the flat knitted tinsel wire ends (extended portions) 2*ha* and 2*hb*, so that even if the ends of the sewing threads are loosened, the deeper sides of the threads are prevented from being further loosened and unfastened. Since the sewing threads 3 extended to the flat knitted tinsel wire ends, a conventional phenomenon that the sewing threads 3 are loosened up to the position of the roll 11*r* occurred not at all.

In this embodiment, solder was not applied to the ends (extended portions) 2*ha* and 2*hb* of the flat knitted tinsel wires 2*h*. However, this soldering process may be performed in the manner proposed by the present inventors. Namely, cream solder is coated on the surfaces of the flat knitted tinsel wires 2*h* over the square holes. At the same time when the edges are subjected to the thermal mold, the solder coated portions are thermally pressed. Therefore, the cream solder melts and attaches to the conductor surfaces of the flat knitted tinsel wires 2*h*. In this manner, the soldering process for the ends (extended portions) 2*ha* and 2*hb* of the flat knitted tinsel wires 2*h* becomes possible. With this soldering process, an unfastened state at the ends of the flat knitted tinsel wires 2*h* to be caused by the trimming process of punching out can be prevent more reliably, and soldering with the terminal lugs 4 becomes easier.

The size of the sewn conductive edge 1E*s* after the triming process is 202 mm long and 48 mm wide, with the longer and shorter sides being connected by arcs having a radius of 24 mm. An adhesion portion 12 of about 3 mm width for adhering an edge frame is formed at the outermost circumferential area, the roll 11*r* having a width of 6 mm and a cross section radius of 3 mm is formed inside of the adhesion portion, and other adhesion portions 14 are formed inside of the roll 11*r*. The adhesion portions are used for adhering a diaphragm df.

The diaphragm df made of pulp and having an elongated and generally flat shape as shown in FIG. 4 is adhered to the adhesion portion. In this embodiment, as described earlier, the design conditions are that the edge roll 11*r* is an up-roll and that the edge adhesion portions 14 used for adhering the diaphragm df and the voice coil wiring portions are not visible from the front side of the loudspeaker. Therefore, as shown in FIG. 4, the edge adhesion portions 14 are adhered to the back side of the diaphragm to form the diaphragm df with the sewn conductive edge 1E*s*.

Figure 5:
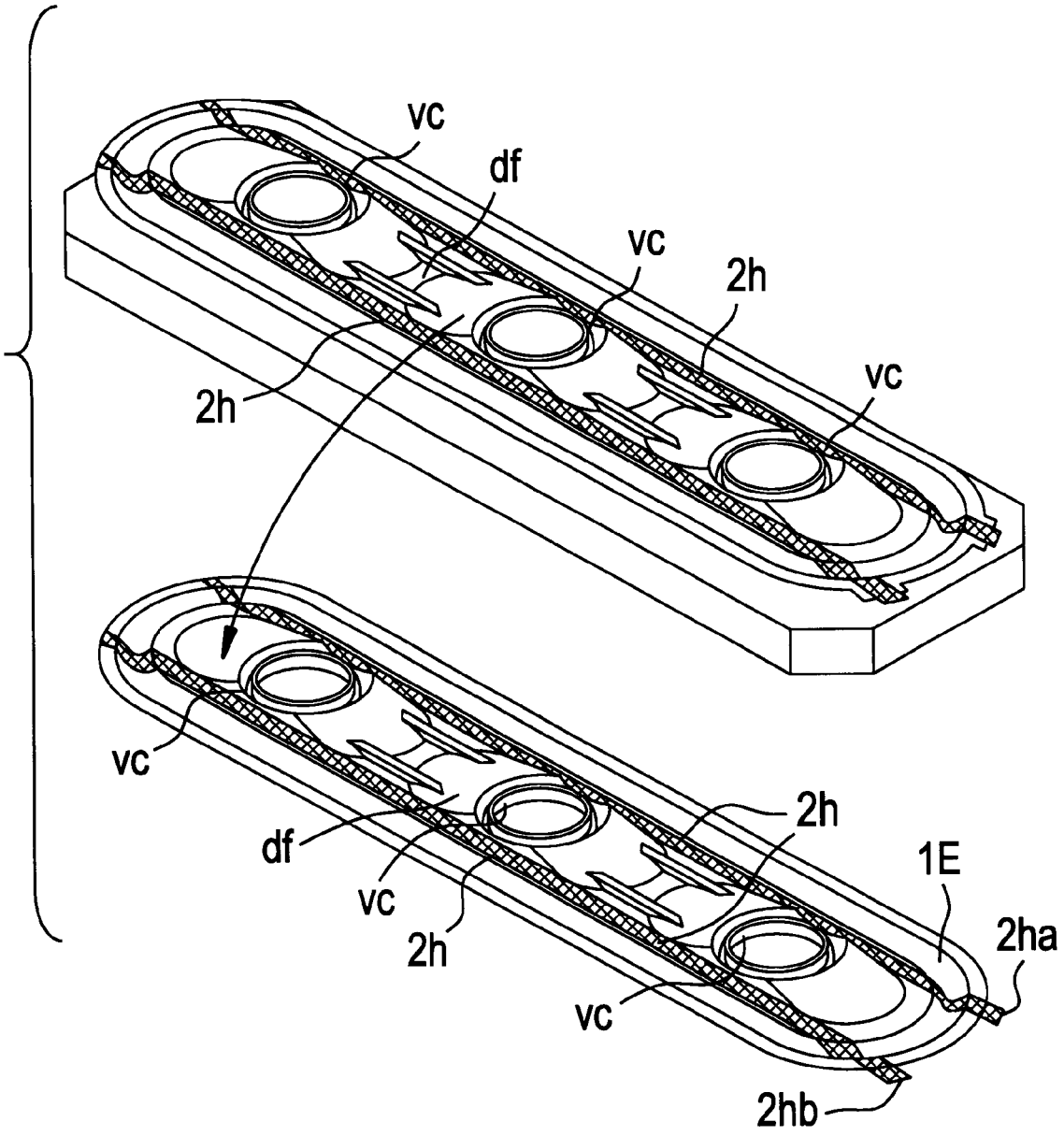
FIG. 5 is perspective views showing the back side of the sewn conductive edge mounted with the diaphragm and with voice coils, according to the present invention.

Since three voice coil mount holes df1 are formed in the diaphragm df with the sewn conductive edge 1E*s*, as shown in FIG. 5, the outer peripheries of voice coils vc are inserted into the holes df1 to adhere the outer peripheries of the voice coils vc to the diaphragm df. The ends of the voice coils vc are electrically connected to the flat knitted tinsel wires 2*h*. Since the wiring portions of the voice coils vc are disposed on the back side of the diaphragm, the above design conditions that the wiring portions of the voice coils vc are not visible from the front side of the loudspeaker can be satisfied.

Figure 6:
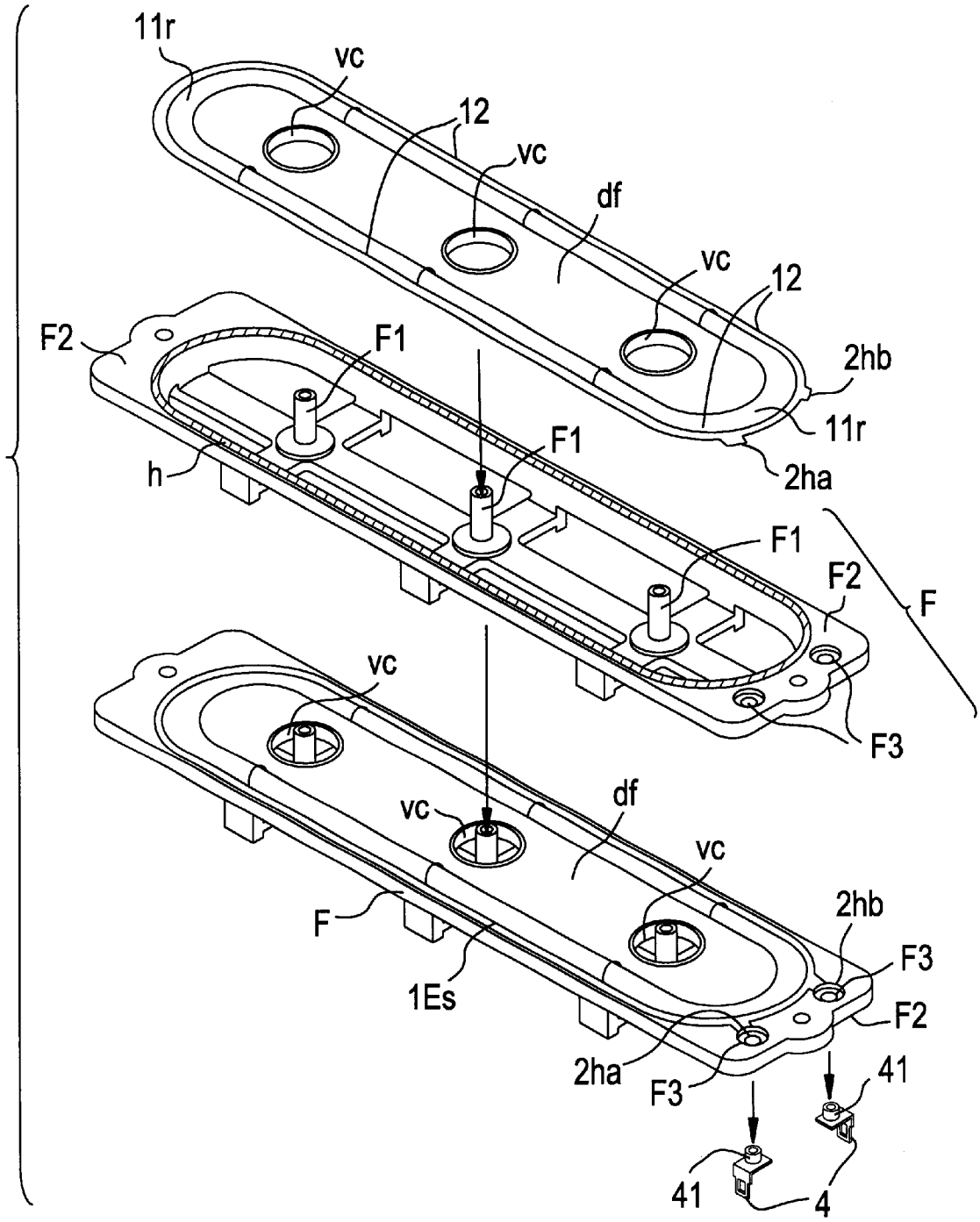
FIG. 6 is perspective views showing the states of voice coils, a diaphragm with a sewn conductive edge, and input terminal lugs, respectively mounted on a frame, as viewed from the front side of the loudspeaker.
Figure 7:
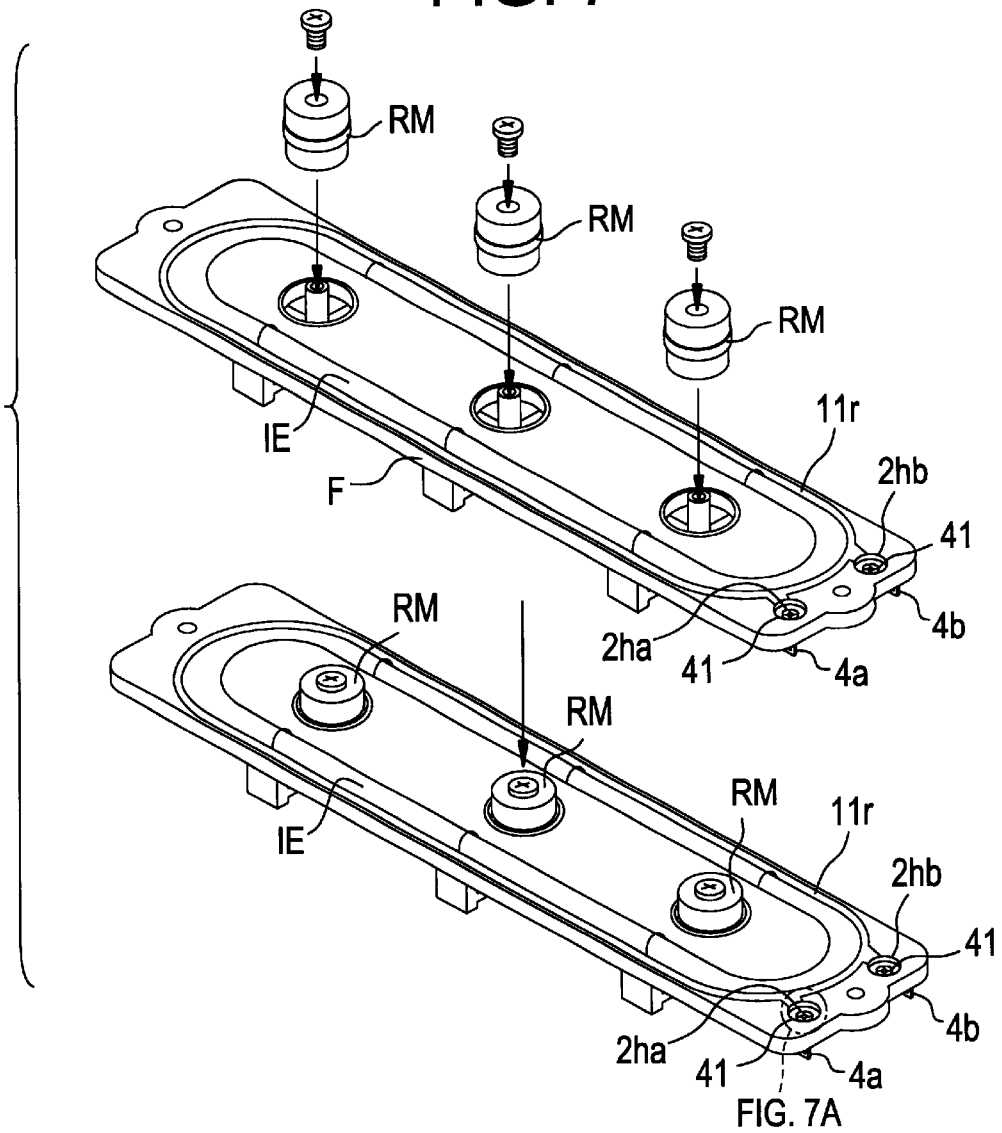
FIG. 7 is perspective views showing a completed state of a multi-point drive type loudspeaker mounted with repulsion magnetic circuits after the voice coils, diaphragm with the sewn conductive edge, and input terminal lugs are mounted on the frame, and a partially enlarged view showing the wiring state between flat knitted tinsel wire ends and input terminal lugs.
Figure 7A:
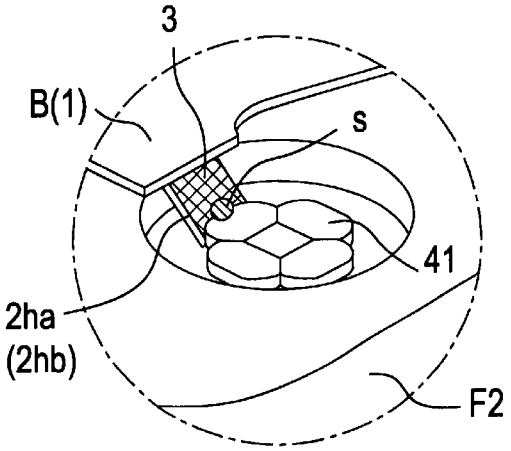
Figure 8:
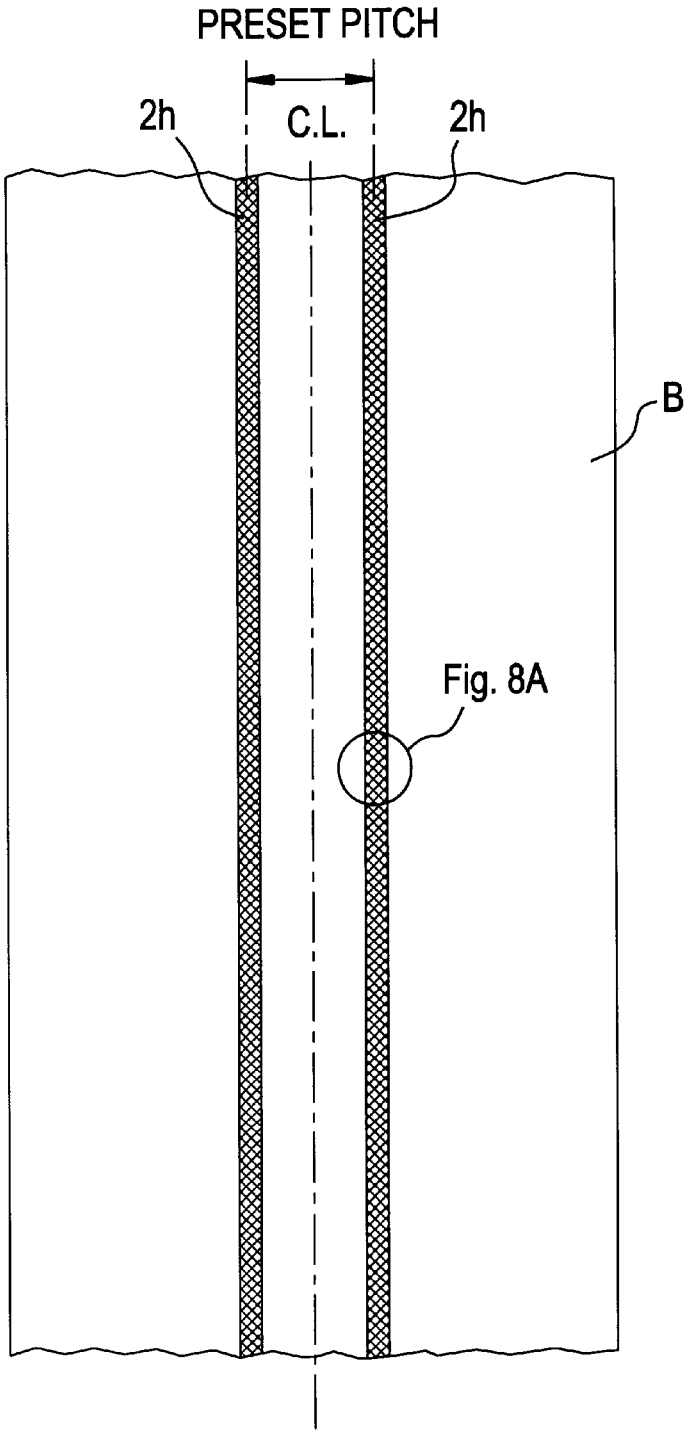
FIG. 8 is a plan view and a partially enlarged view showing a base cloth of a conventional sewn conductive damper with flat knitted tinsel wires being sewn by sewing threads.
Figure 8A:
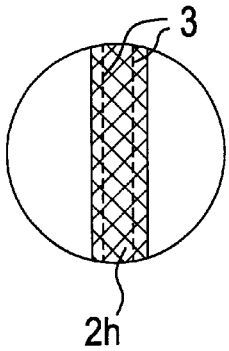
Figure 9:
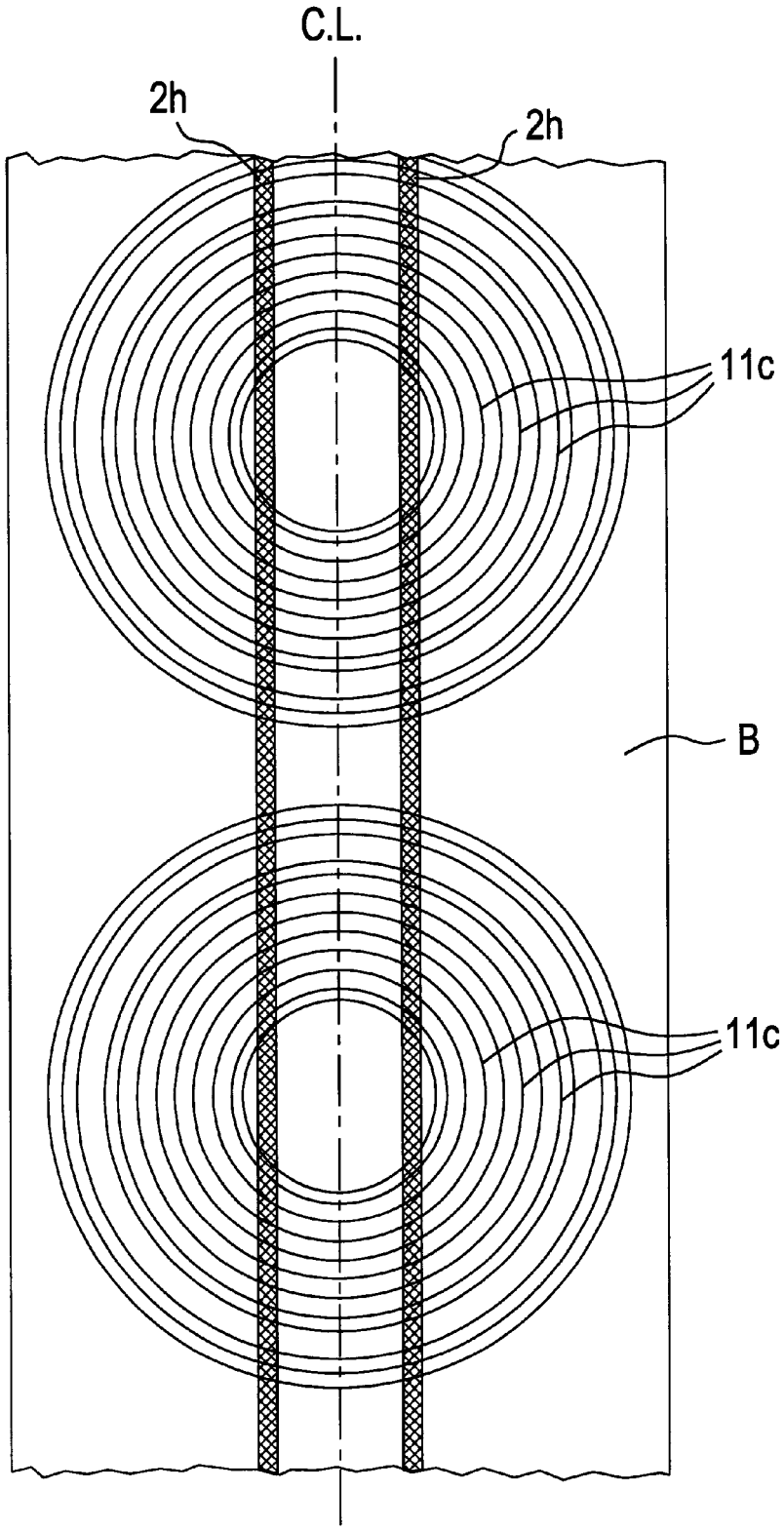
FIG. 9 is a plan view showing a base cloth of a conventional sewn conductive damper with flat knitted tinsel wires being sewn by sewing threads and with corrugations and the like being thermally molded.
Figure 10:
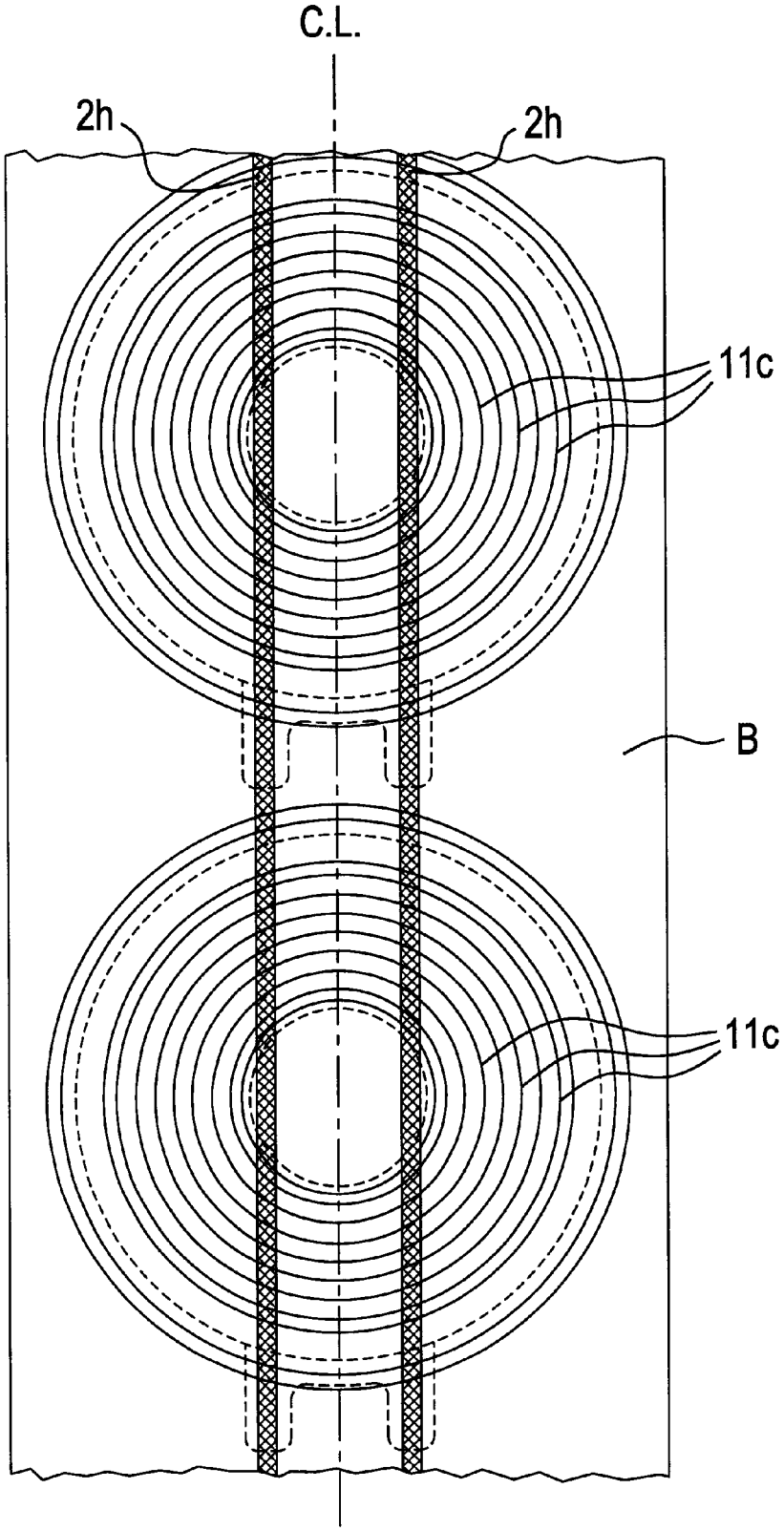
FIG. 10 is a plan view showing portions to be trimmed from a base cloth of a conventional sewn conductive damper with flat knitted tinsel wires and with corrugations and the like being thermally molded.
Figure 11A:
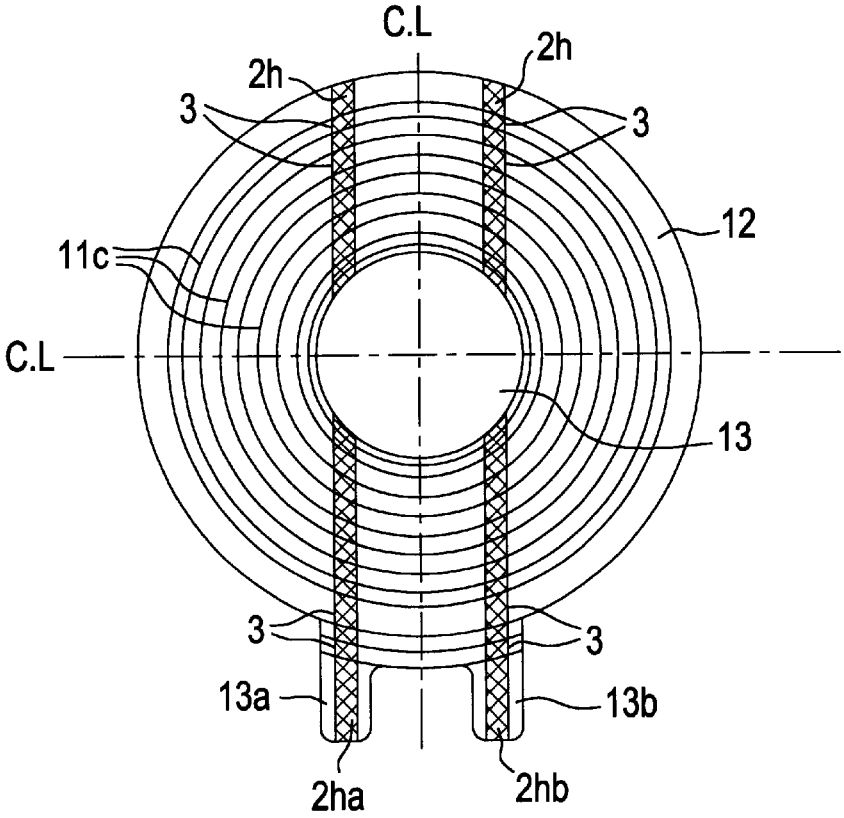
FIGS. 11A and 11B are a plan view and a perspective view showing a conventional completed sewn conductive damper.
Figure 11B:
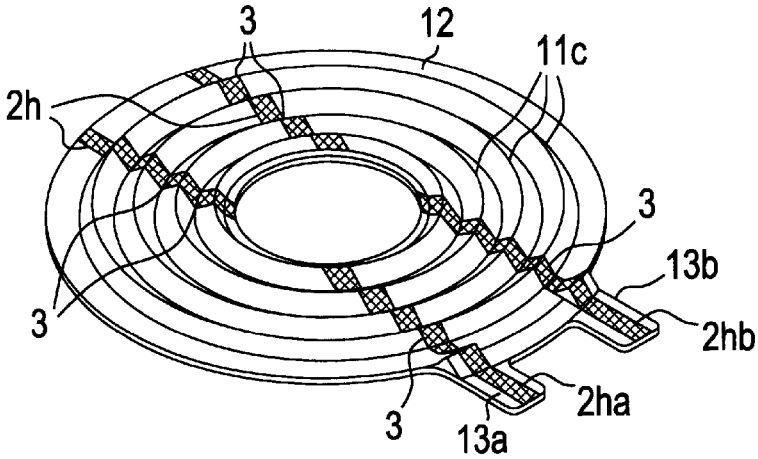
Figure 12:
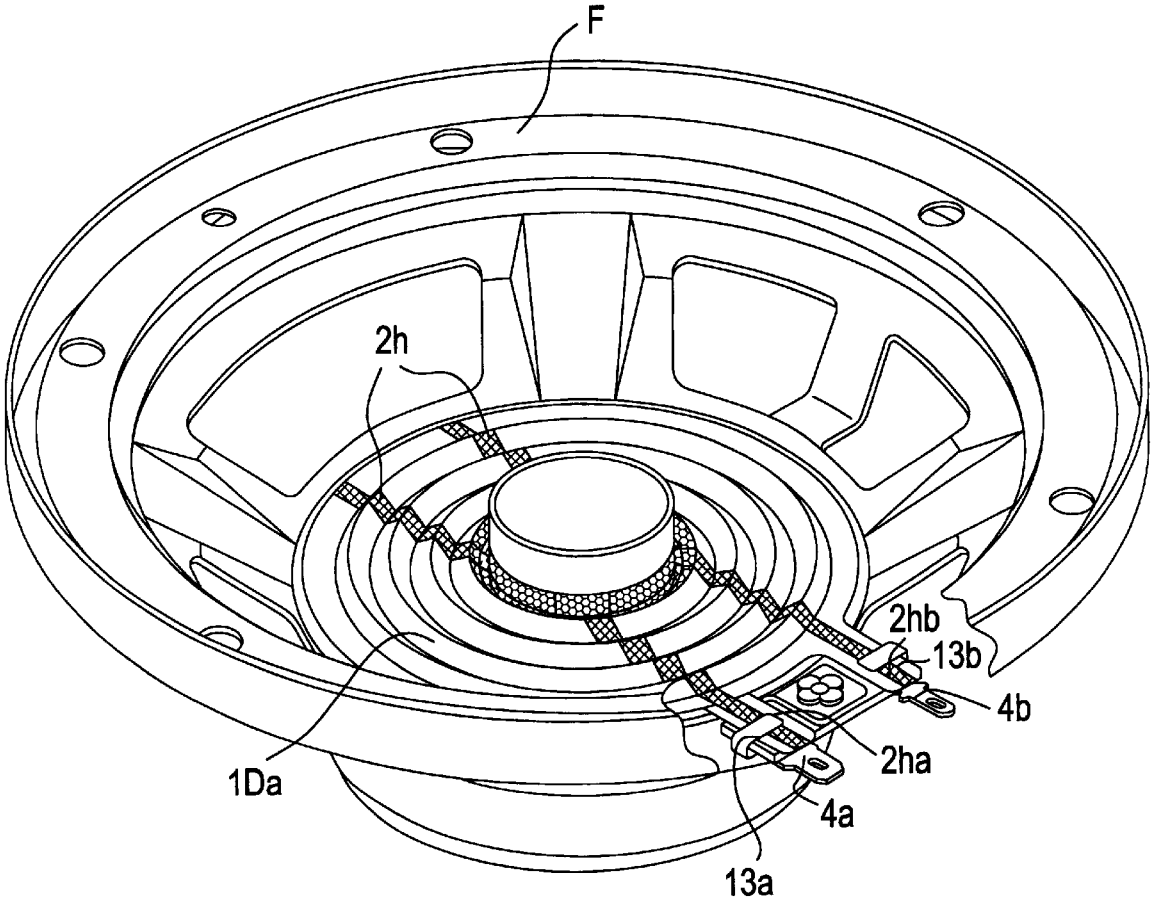
FIG. 12 is a perspective view showing a conventional sewn conductive damper mounted on a loudspeaker frame and having input terminal lugs electrically connected.
Figure 13:
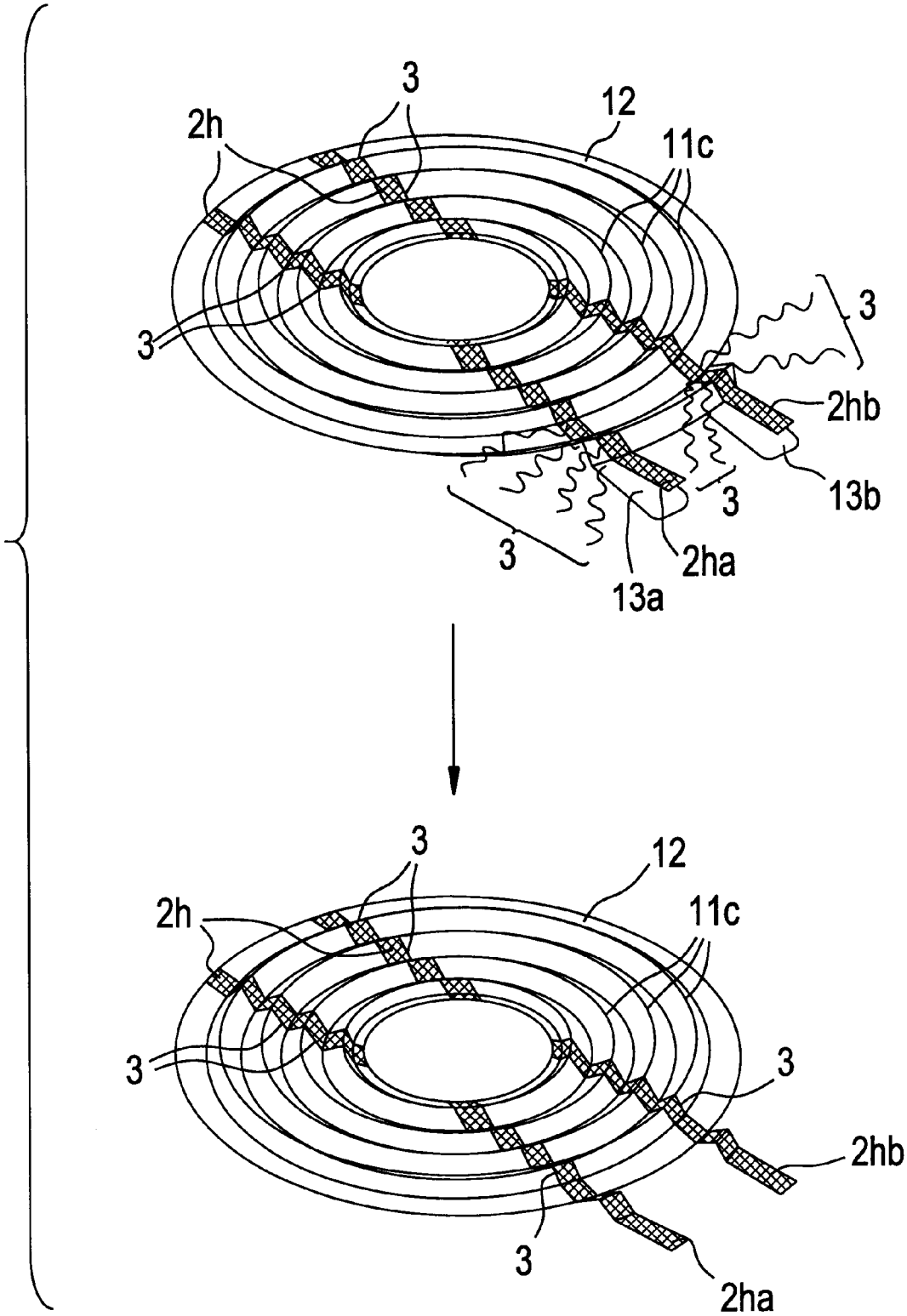
FIGS. 13A and 13B are perspective views showing a conventional sewn conductive damper with flat knitted tinsel wires whose sewing threads are loosened so as not to make the damper base cloth intervene the wires.
Figure 14:
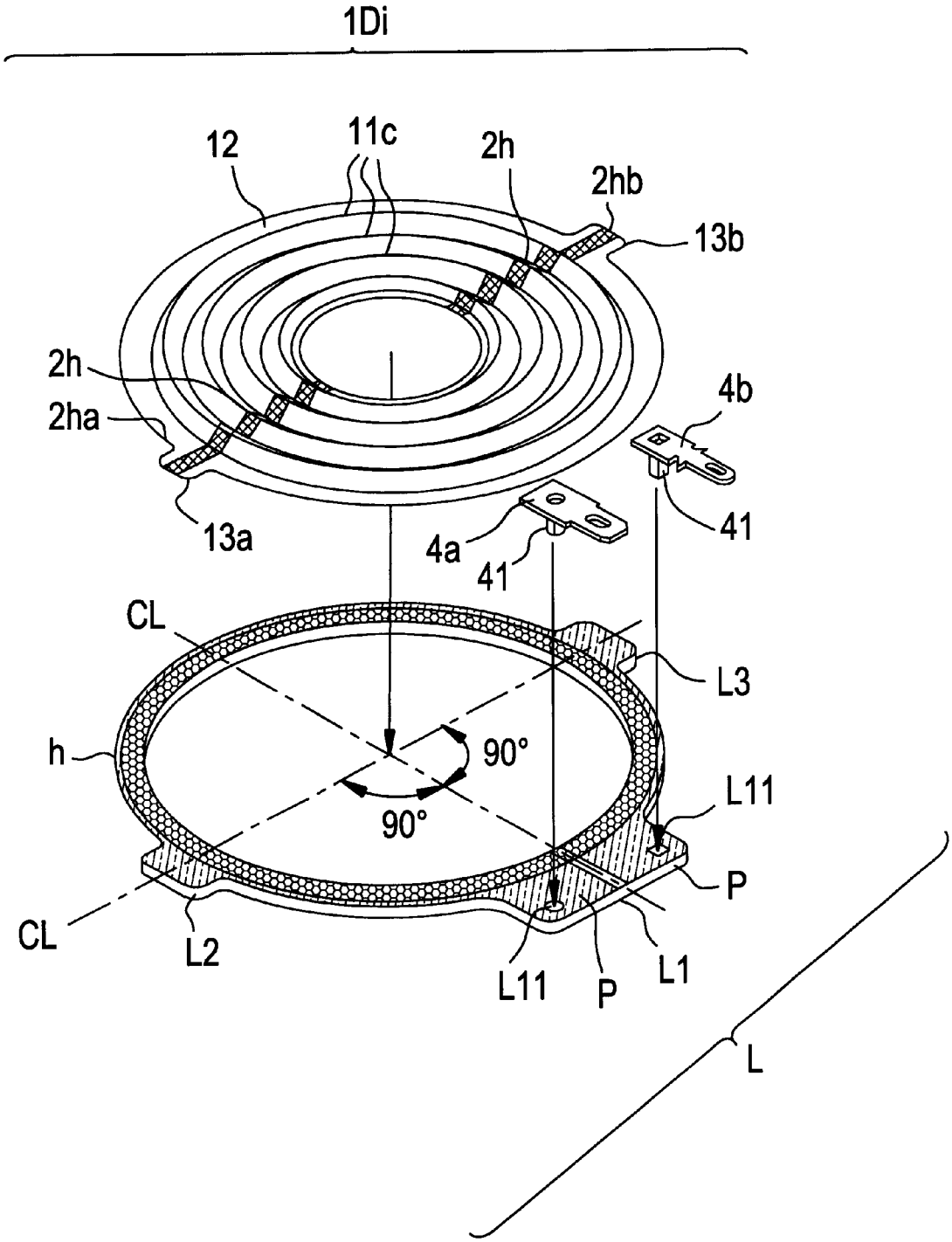
FIG. 14 is perspective views showing a conventional sewn conductive damper, a terminal ring with wiring patterns, and input terminal lugs, respectively before assembly.
Figure 15:
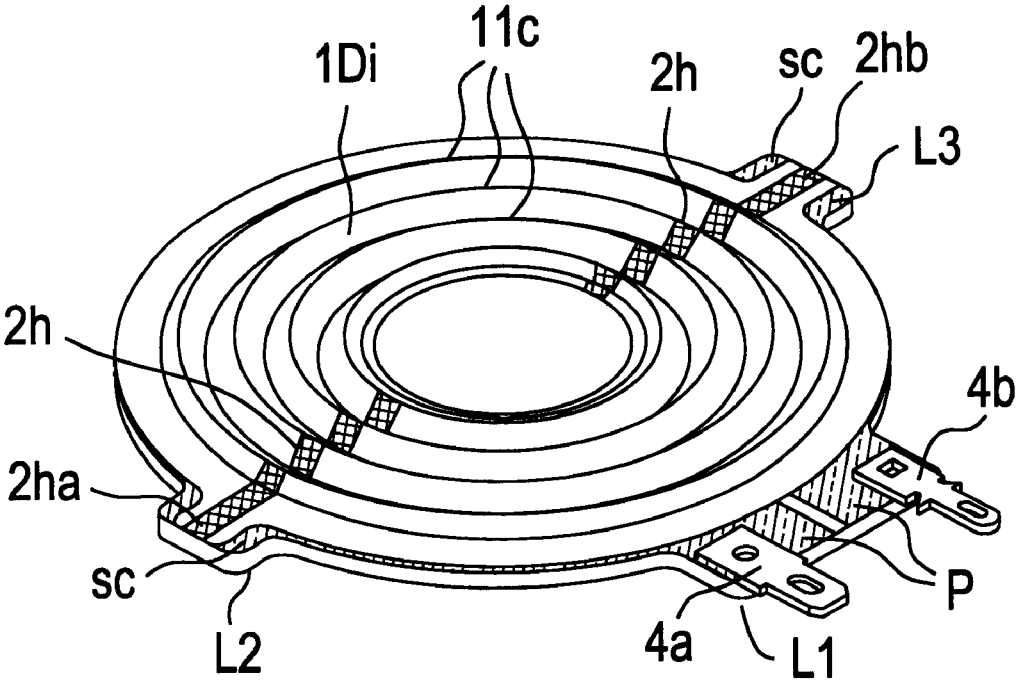
FIG. 15 is perspective views showing a conventional sewn conductive damper, a terminal ring with wiring patterns, and input terminal lugs, respectively after assembly.
Figure 16A:
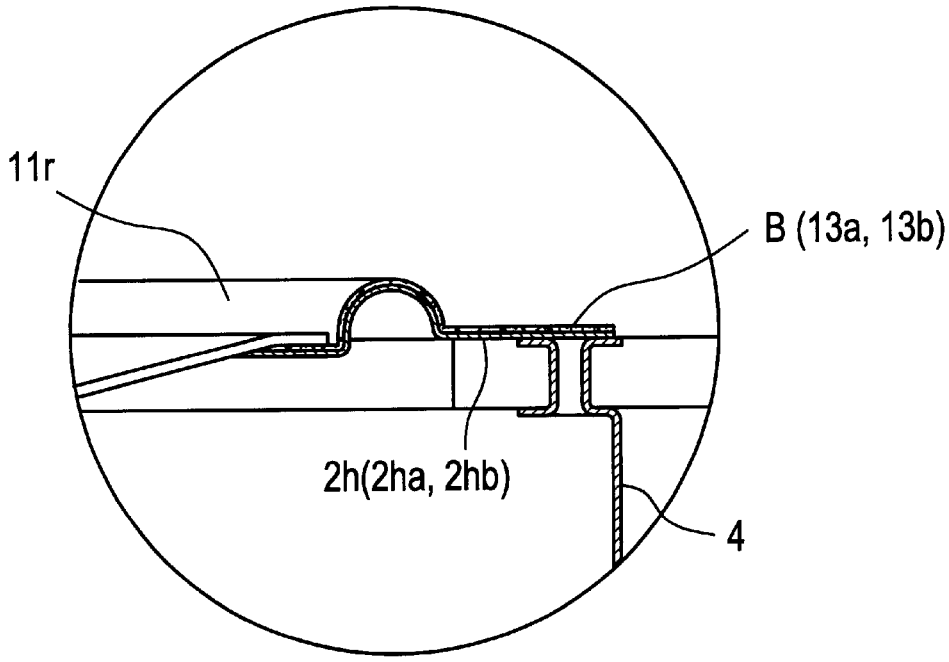
FIGS. 16A and 16B are partially enlarged cross sectional views showing a conventional conductive edge with a conductor such as a flat knitted tinsel wire being mounted on the back side of the conductive edge, and showing the positional relation with an input terminal lug.
Figure 16B:
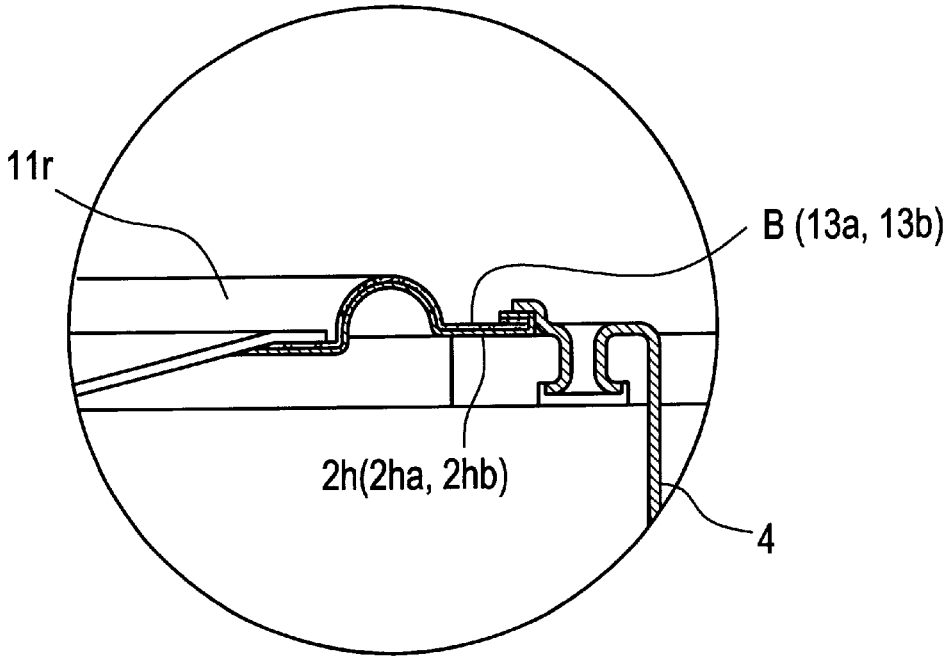

In this embodiment, the sewn conductive edge 1E*s* and the diaphragm df with the voice coils vc are adhered to a frame F shown in FIG. 6. The frame F is made of ABS resin which contains glass fibers, and has a size of 228 mm long, 49.6 mm wide, and 15 mm deep. Three poles F1 having a diameter of 5 mm and a height of 14 mm are integrally formed on the bottom of a frame basket, respectively at the center of the frame F, and at positions separated from the center by 60 mm in the longitudinal direction.

On one of flanges F2 provided on the shorter side of the frame F for mounting the frame F, two holes F3 for mounting the input terminal lugs 4 are formed as shown in FIG. 6. This hole F3 is a square hole having a side length of 2.5 mm and passes through the flange F2. A counterbore having a diameter of 8 mm and a depth of 1 mm is formed on the front side of the flange F2, concentrically with the square hole F3. A pitch between the square holes F3 is the same as the pitch (26 mm) between the flat knitted tinsel wires 2*h* sewn on the sewn conductive edge 1E*s*.

As shown in FIG. 6, adhesive h is coated on the edge adhesion area of the frame F. Although not shown, after a voice coil vc positioning jig is fitted around the poles F1, the inner peripheries of the voice coils vc on the diaphragm df with the sewn conductive edge 1E*s* are fitted around the outer peripheries of the jig. As shown in FIG. 6, in order to satisfy the above-described design conditions, the diaphragm df is turned upside down to maintain the edge in an up-roll 11*r* state, the voice coils vc and the wiring portions to the flat knitted tinsel wires 2*h* are disposed on the back side of the diaphragm so as to make the wiring portions not visible, and the ends (extended portions) 2*ha* and 2*hb* of the flat knitted tinsel wires 2*h* are aligned with the holes F3 for mounting the input terminal lugs 4.

After the insertion in the above-described state, the adhesion portion 12 at the outer peripheral area of the sewn conductive edge 1E*s* contacts with the adhesive. By pressing and fixing the adhesive portion, the sewn conductive edge 1E*s* with the voice coils vc is adhered to the frame F at a predetermined position, while the voice coils are adhered at the predetermined positions of the frame F. Obviously, in this case, although parts of the flat knitted tinsel wires 2*h* are adhered to the back side of the frame, both the front and back surfaces of the ends (extended portions) 2*ha* and 2*hb* of the flat knitted tinsel wires 2*h* are disposed covering halves of the counterbores of the holes F3 for mounting the input terminal lugs 4 and exposing copper foils of the tinsel wires constituting the flat knitted tinsel wires 2*h*, as shown in FIG. 6.

In this state, the input terminal lugs 4 are mounted. These terminal lugs are those generally used conventionally and are generally called a fastening terminal lug. This terminal lug is made of a 0.5 mm thick brass plate press-worked and nickel plated. As show in FIG. 6, the lug has at a predetermined position a caulking portion 41 of a square tube shape having a side length of 2.5 mm, a height of about 3.5 mm and a side thickness of about 0.5 mm. A lug 4*a* is a positive terminal and a lug 4*b* is a negative terminal.

A caulking method is quite the same as a conventional method of mounting a terminal lug to a terminal substrate. As shown in FIG. 6, the caulking portion is inserted into the mounting square hole F3 from the back side of the frame flange F2. As shown in a partially enlarged view of FIG. 7, each side of the caulking portion 41 is bent outward into four equal pieces, while the corners of the top edge of the caulking 41 extended to the front side of the frame is broken. In this manner, the input terminal lugs 4 are caulked relative to the frame F.

In this embodiment, part of the caulking portion 41, i.e., one side of four bent pieces, and the counterbore of the terminal mounting hole F3, squeeze the end (extended portion) 2*ha*, 2*hb* of the flat knitted tinsel wire 2*h* when the lug 4 is mounted on the frame F. In this mount state, the terminal lug 4 is electrically connected to the voice coil vc. Generally, this squeezed state of the flat knitted tinsel wire ends 2*ha* and 2*hb* does not pose a practical problem of electrical conduction quality. However, in this embodiment, the boundary area between the flat knitted tinsel wire ends (extended portions) 2*ha* and 2*hb* and the lug caulking portions 41 are soldered as shown in the partially enlarged view of FIG. 7.

Since the whole surface of the conductor (copper foil) of the flat knitted tinsel wire ends (extended portions) 2*ha* and 2*hb* is exposed, other electrical connections may be performed. For example, the input terminal lugs 4 are first mounted on the frame F, and then the voice coils vc and the diaphragm df with the sewn conductive edge 2E*s* are adhered to the frame F. After the diaphragm df is adhered, the flat knitted tinsel wire ends (extended portions) 2*ha* and 2*hb* are directly soldered to parts of the four equal pieces of the input terminal lugs 4.

With the above processes, the voice coils vc, diaphragm df, sewn conductive edge 1E*s*, and input terminal lugs 4 are all adhered to the frame F, and the wiring process is completed. Thereafter, the coil positioning jig is dismounted, and three repulsion magnetic circuits RM are mounted on the poles F1 of the frame F to form a loudspeaker of an elongated multi-point drive type.

In a loudspeaker having the conductive suspension structure 1, the ends 2*ha* and 2*hb* of the conductor 2 such as the flat knitted tinsel wires 2*h* can be disposed without the suspension base cloth B. Even if the conductor 2 is disposed on the front or back side of the base cloth B, the ends 2*ha* and 2*hb* of the conductor 2 are not affected by the base cloth B and exposed perfectly. Therefore, the input terminal lugs 4 or the like can be electrically connected by the most prevailing soldering method, more easily than conventional. This is effective for simplifying the electrical connection structure and for improving the degree of design freedom considerably.

In manufacturing the conductive suspension 1, the ends 2*ha* and 2*hb* of the conductor 2 can be disposed easily without the suspension base cloth B, only by adding a conventional simple punching press process. Furthermore, a method of sewing the flat knitted tinsel wires 2*h* can be applied, which is most prevailing and low in cost. Therefore, it is possible to provide a loudspeaker conductive suspension of low cost and a considerably improved degree of wiring freedom.

Since the ends 2*ha* and 2*hb* of the conductor such as the flat knitted tinsel wires 2*h* are disposed without the suspension device and the sewing thread 3 extends to the ends (extended portions) 2*ha* and 2*hb* of the flat knitted tinsel wires 2*h*, the above-described phenomenon that the sewing threads 3 extending to the flat knitted tinsel wire ends 2*ha* and 2*hb* are loosened does not occur at all. It is therefore possible to provide a loudspeaker with a conductive suspension of very high quality and a wiring method for such a loudspeaker.

What is claimed is:

1. A method of fabricating a loudspeaker suspension device having a suspension (1) and voice coil connection conductors (2*h*) mounted on a surface of the suspension (1), comprising:

mounting the planar voice coil connection conductor line along a surface of a planar base member strip;

pressure molding the base member strip (B) mounted by the voice coil connection conductor line into a predetermined shape, and trimming the pressure-molded base member strip into a suspension device, characterized in that;

the base member strip on which the voice coil connection conductor line is to be mounted includes cut portions (B1) at positions corresponding to signal input ends (2*ha*, 2*hb*) of voice coil connection conductors for the suspension device;

the cut portions are bridged with the planar voice coil connection conductor line mounted on the base member strip, and the signal input end (2*ha*, 2*hb*) of the voice coil connection conductor is left as a projection at the cut portion of the base member for the trimmed suspension device.

2. A method according to claim 1, wherein the cut portions are holes formed in the base member strip.

3. A method according to claim 1, wherein a thread sews the voice coil connector conductor line onto the base member strip.

4. A method according to claim 2, wherein a thread sews the voice coil connector conductor line onto the base member strip.

5. A method according to claim 3, wherein the thread is sewed into the voice connector conductor line at the cut portions of the base member strip.

6. A method according to claim 4, wherein the thread is sewed into the voice connector conductor line at the cut portions of the base member strip.

7. A method according to claim 1, wherein the base member strip has a longitudinal length to form a plurality of suspension devices and each individual suspension device is trimmed traversely at the cut portion of the base member strip.

8. A method according to claim 2, wherein the base member strip has a longitudinal length to form a plurality of suspension devices and each individual suspension device is trimmed traversely at the cut portion of the base member strip.

9. A method according to claim 3, wherein the base member strip has a longitudinal length to form a plurality of suspension devices and each individual suspension device is trimmed traversely at the cut portion of the base member strip.

10. A method according to claim 4, wherein the base member strip has a longitudinal length to form a plurality of suspension devices and each individual suspension device is trimmed traversely at the cut portion of the base member strip.

11. A method according to claim 5, wherein the base member strip has a longitudinal length to form a plurality of suspension devices and each individual suspension device is trimmed traversely at the cut portion of the base member strip.

12. A method according to claim 6, wherein the base member strip has a longitudinal length to form a plurality of suspension devices and each individual suspension device is trimmed traversely at the cut portion of the base member strip.

* * * * *

UNITED STATES PATENT AND TRADEMARK OFFICE

CERTIFICATE OF CORRECTION

PATENT NO. : 6,332,262 B1
DATED : December 25, 2001
INVENTOR(S) : Yoshi Sakamoto It is certified that error appears in the above-identified patent and that said Letters Patent is hereby corrected as shown below:

Title page,
Item [73], Assignee, insert -- Mogami Denki Kabushiki Kaisha --

Signed and Sealed this

Twenty-fifth Day of March, 2003

JAMES E. ROGAN
*Director of the United States Patent and Trademark Office*